US005456143A

United States Patent [19]

Stanton

[11] Patent Number: 5,456,143

[45] Date of Patent: Oct. 10, 1995

[54] OPEN END RATCHET WRENCH

[76] Inventor: John L. Stanton, 3600 Baywood Dr., Nacogdoches, Tex. 75961

[21] Appl. No.: 219,147

[22] Filed: Mar. 29, 1994

[51] Int. Cl.[6] ..... B25B 13/12

[52] U.S. Cl. ..... 81/179; 81/91.1; 81/91.3

[58] Field of Search ..... 81/91.1, 91.2, 81/179

[56] References Cited

U.S. PATENT DOCUMENTS

| | | | |
|---|---|---|---|
| 2,712,259 | 7/1955 | Cowell . | |
| 3,921,474 | 11/1975 | Dyck et al. | 81/91.2 |
| 3,927,582 | 12/1975 | Hertelendy et al. . | |
| 4,204,440 | 5/1980 | Del Prete et al. | 81/179 X |
| 4,488,459 | 12/1984 | Bailey et al. . | |
| 4,574,665 | 3/1986 | Blachly . | |
| 4,644,830 | 2/1987 | Bailey et al. . | |
| 4,718,315 | 1/1988 | Nitschmann . | |
| 4,926,720 | 5/1990 | Srzanna . | |

FOREIGN PATENT DOCUMENTS

| | | | |
|---|---|---|---|
| 568058 | 12/1923 | France | 81/179 |

OTHER PUBLICATIONS

*Griot's Garage*, "Ratchet Flare Nut Wrench," p. 7, Spring, 1994.

*Primary Examiner*—James G. Smith
*Attorney, Agent, or Firm*—Fish & Richardson

[57] ABSTRACT

An open-end ratchet wrench has a pair of elongated plates that are pivotally mounted to a pair of spaced jaws on the wrench handle and that include at least one elongated surface for engaging a face of a workpiece onto which the jaws are inserted. A spring mounted on the handle biases the elongated plates toward each other so that the elongated plates grasp the workpiece between the elongated surfaces and rotate the workpiece when said handle is rotated in a first direction. The biasing of the spring is overcome when the handle is rotated in a second, opposite direction so that the elongated surfaces of the plates slide over faces of the workpiece (e.g., in a ratcheting manner), allowing the workpiece to remain stationary.

24 Claims, 6 Drawing Sheets

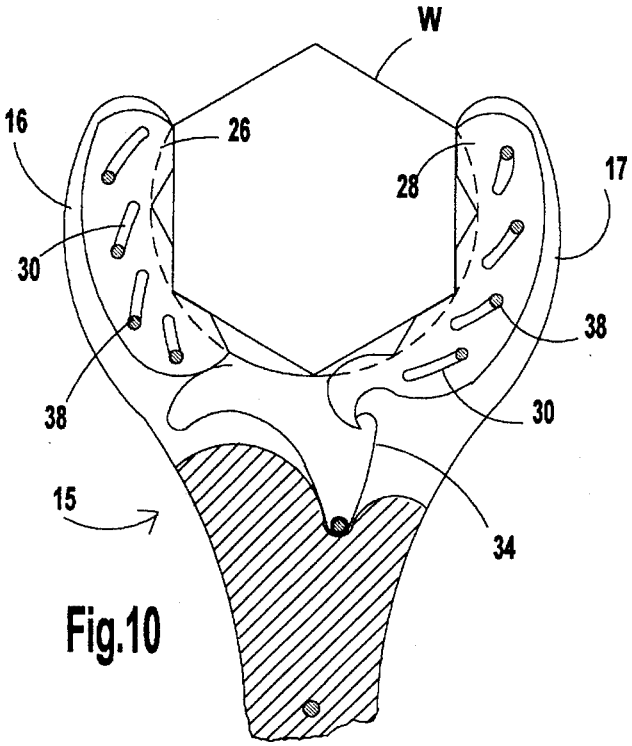
Fig.10
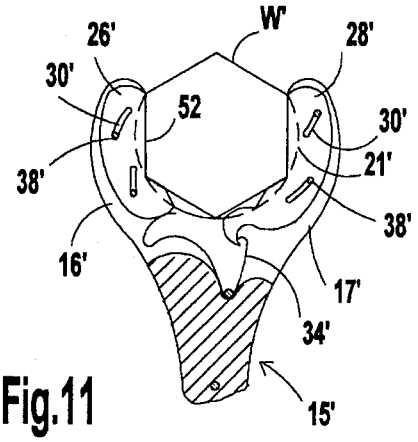
Fig.11
Fig.13
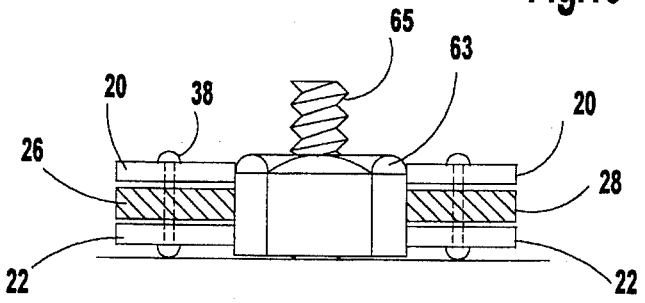
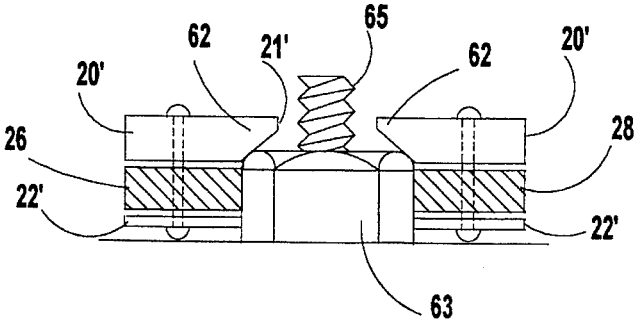
Fig.12

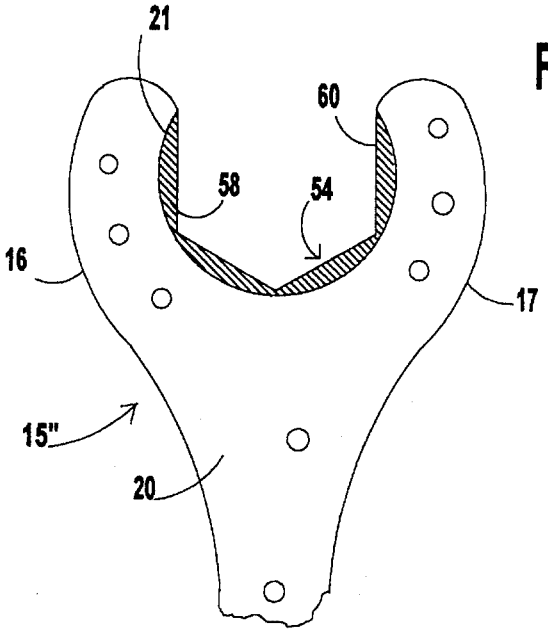
Fig.14
Fig.15
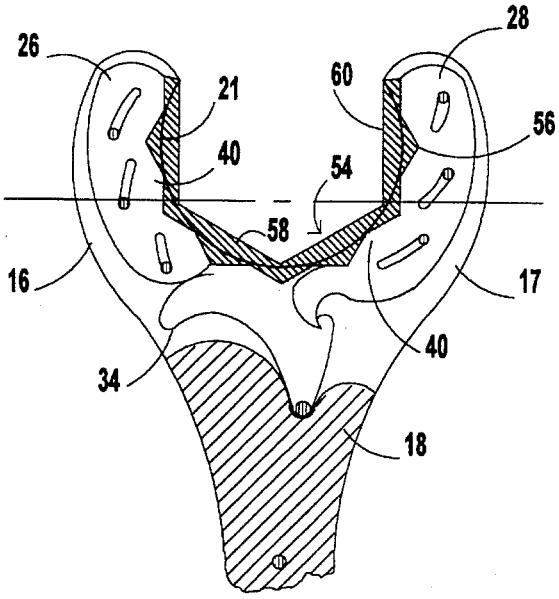
Fig.16
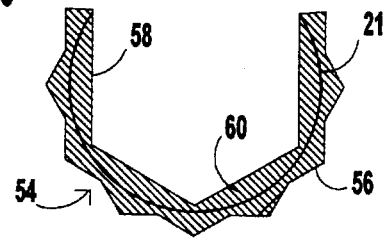
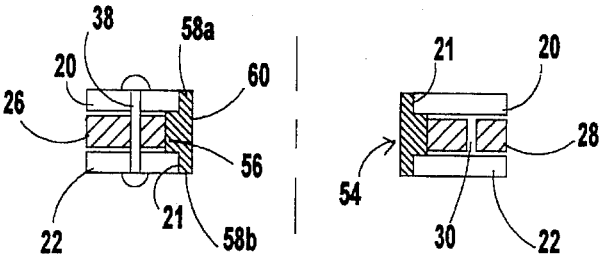
Fig.17

OPEN END RATCHET WRENCH

BACKGROUND OF THE INVENTION

This invention relates to ratchet wrenches, and more particularly to open-end ratchet wrenches that can be placed on a workpiece from the side.

There are many occasions when it is desirable to apply torque to a workpiece (such as nuts, bolts, and in-line hydraulic fittings) in order to, for example, rotate the workpiece with respect to a threaded member. Two well known tools for rotating workpieces are ratchet wrenches and open-end crescent wrenches. Ratchet wrenches are typically close-ended devices that completely encircle the workpiece and are thus installed on the workpiece from the top (or bottom, depending upon the orientation of the workpiece). By contrast, open-end wrenches can be installed from the side of the workpiece.

Open-end wrenches are particularly useful in small spaces where there may only be sufficient room to install the wrench from the side. Moreover, in confined spaces, there is often insufficient space to accommodate the ratchet mechanism of typical close-ended ratchet wrenches. In addition, open-end wrenches are a must for tightening/loosening in-line fittings of hydraulic or fuel lines, which can only receive a wrench from the side.

Typical open-end crescent wrenches lack a ratchet mechanism. As a result, during a tightening or loosening operation, the wrench must be removed from the workpiece after it has rotated the workpiece a relatively small amount (such as 30 degrees), and then replaced thereon at a different angle for continued rotation. This procedure is repeated (often many times) until the workpiece is completely tightened or loosened.

Open-end ratchet wrenches that resemble typical crescent wrenches have been developed for confined and in-line fitting applications. Some open-end ratchet wrenches employ numerous spring-loaded rollers, cams, or pawls for engaging the workpiece; others use an insert shaped to fit over the workpiece and engage an internal ratchet mechanism. Some of these wrenches encircle the workpiece to such an extent that, even though the wrenches have open ends, they must actually be installed vertically from above or below the workpiece.

SUMMARY OF THE INVENTION

This invention features an open-end ratchet wrench having a pair of elongated plates that are pivotally mounted to a pair of spaced jaws on the wrench handle and include at least one elongated surface for engaging a face of a workpiece onto which the jaws are inserted; a spring biases the elongated plates toward each other so that the elongated plates grasp the workpiece between the elongated surfaces and rotate the workpiece when the handle is rotated in a first direction, and the biasing is overcome when the handle is rotated in a second, opposite direction so that the elongated surfaces of the plates slide over faces of the workpiece, allowing the workpiece to remain stationary. Thus, the wrench tightens (or loosens) the workpiece when the user rotates the wrench in the first direction, and the wrench slips over the workpiece in a "ratcheting" manner when rotated by the user in the second, opposite direction.

This invention unites features of an open end wrench and a ratchet wrench in a wrench that is rugged and simple to make. The wrench has a minimal number of moving parts—the elongated plates and the spring—and thus is much easier to manufacture (and repair) than wrenches which employ many individual pawls or rollers in the ratcheting mechanism. The elongated plates each engage the workpiece over a relatively large surface area, thereby maximizing torque transmission and minimizing contact stresses imposed on the wrench and the workpiece. This reduces the risk of damage to the wrench and the workpiece.

The spacing between the jaws and the configuration of the elongated plates permit the elongated plates to operate the workpiece while engaging only four faces of the workpiece and encircling the workpiece through an arc of only 240 degrees. As a result, the wrench can easily be inserted onto and removed from the workpiece from the side for ease of use in cramped spaces. The ratcheting mechanism provided by the spring-biased elongated plates makes the tightening or loosening of the workpiece fast and easy while requiring no clearance behind the workpiece.

Preferred embodiments include the following features.

Each of the elongated surfaces is arranged to engage a face of the workpiece over a major portion of the length of the face. Each elongated plate comprises at least one notch that defines a plurality of elongated surfaces each of which is arranged to engage a face of the workpiece. The elongated surfaces defined by the notch are further arranged so that the angle between them equals the angle between a pair of adjacent faces of the workpiece. In one embodiment, each of the elongated plates includes a plurality of notches arranged so that the elongated faces defined by adjacent notches do not simultaneously engage the workpiece faces. The elongated plates may include different numbers of notches (and thus, different numbers of elongated faces).

With such a configuration, the handle need be turned only 30 degrees (i.e., 1/12 of a turn) in the non driving (ratcheting) direction in order to reengage the workpiece and apply torque in the driving (rotating) direction.

In one embodiment, the wrench includes an insert member that forms a first part of the workpiece and is constructed to fit within the notches of the said plates and receive a second part of the workpiece that is to be rotated by the wrench. The workpiece is, for example, a six-sided member such as the head of a bolt, a nut, or an in-line fitting.

The elongated plates and the spring are arranged so that turning the wrench over with respect to the workpiece reverses the operation of the wrench. That is, with the wrench turned over, the wrench tightens or loosens the workpiece when rotated in the second direction (rotating the wrench in the first direction produces the ratcheting action).

In one embodiment, each of the elongated plates is pivotally mounted to a jaw by the engagement of a plurality of pins on the jaw within a corresponding plurality of slots on the elongated plate. The slots in each elongated plate are curved and have a common center of curvature offset from a center of the workpiece.

In another embodiment, each elongated plate is pivotally mounted to a jaw by engagement of one or more curved ridges on the elongated plate with one or more curved grooves on the jaw. The ridges and grooves have, e.g., a triangular or a semicircular cross section. One advantage of this configuration is that it requires even fewer parts than the pins-in-slots embodiment. In addition, the increased area of surface contact provided by the ridge-in-groove configuration makes for a stronger wrench.

The spring is a leaf spring having a pair of ends that respectively engage the pair of elongated plates. At least one of the elongated plates includes a hook for receiving an end of the leaf spring.

The jaws and handle of the wrench are preferably defined by a pair of face plates that are secured together with the elongated plates and spring being captured therebetween. In one embodiment, the jaws defined by one of the face plates includes a lip for retaining the wrench on the workpiece. This face plate preferably is relatively thick to withstand a correspondingly larger amount of force during operation. This allows the other face plate to be made thinner, thereby providing better engagement of the elongated plates with a workpiece that is relatively thin.

Other features and advantages of the invention will become apparent from the following detailed description, and from the drawings.

BRIEF DESCRIPTION OF THE DRAWINGS

FIGS. 10 and 11 show alternative configurations of the elongated plates.

FIG. 12 is an end view of an alternative configuration of head of the wrench of FIG. 1.

FIG. 13 shows the head of the wrench of FIG. 1, viewed from the end of the head.

FIGS. 14–17 are various views illustrating the wrench of FIG. 1 modified for use with a ratchet insert member that is gripped between the elongated plates and engages a nut or the like.

DESCRIPTION OF PREFERRED EMBODIMENTS

Figure 1:
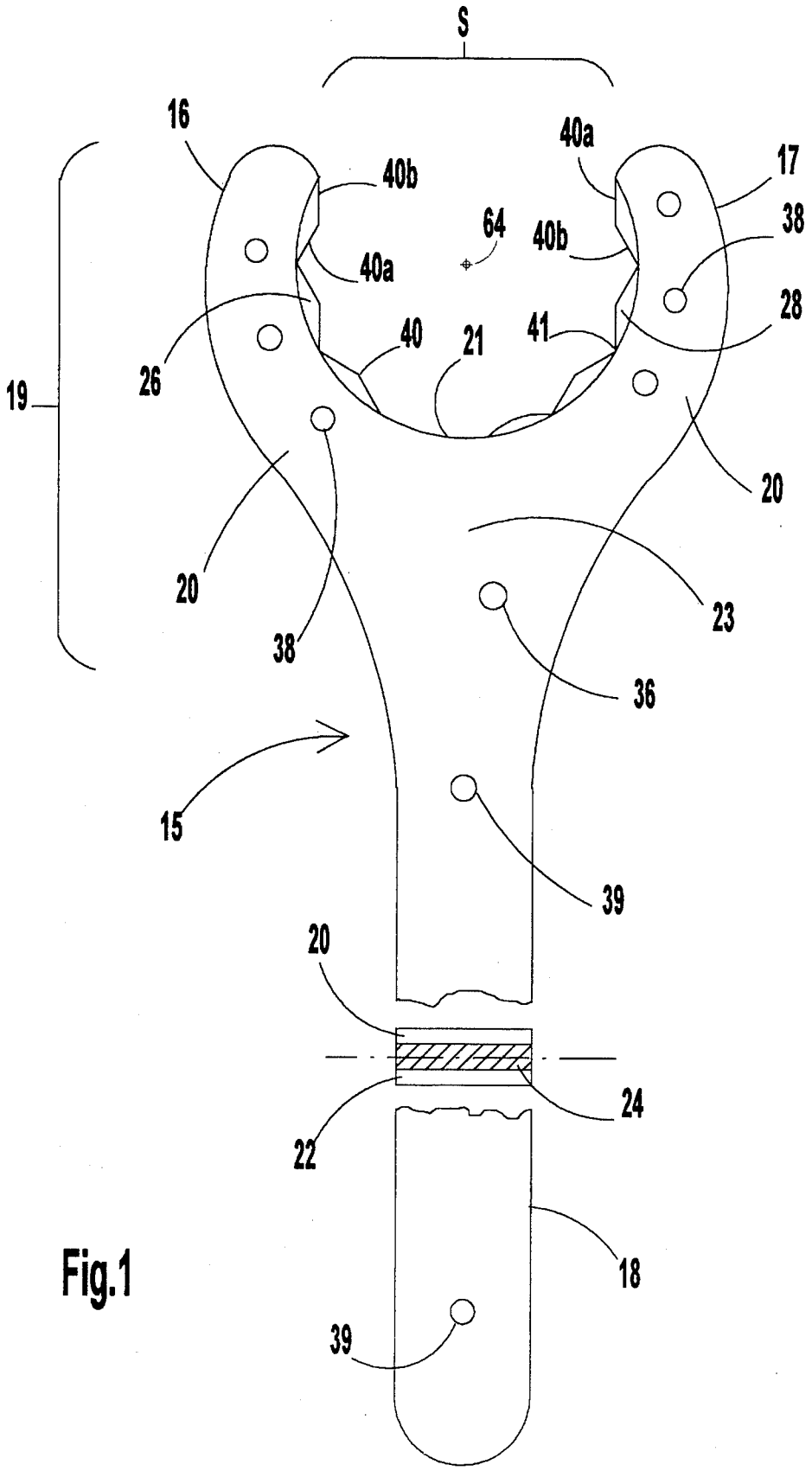
FIG. 1 is a top plan view of an open-end ratchet wrench.
Figure 2:
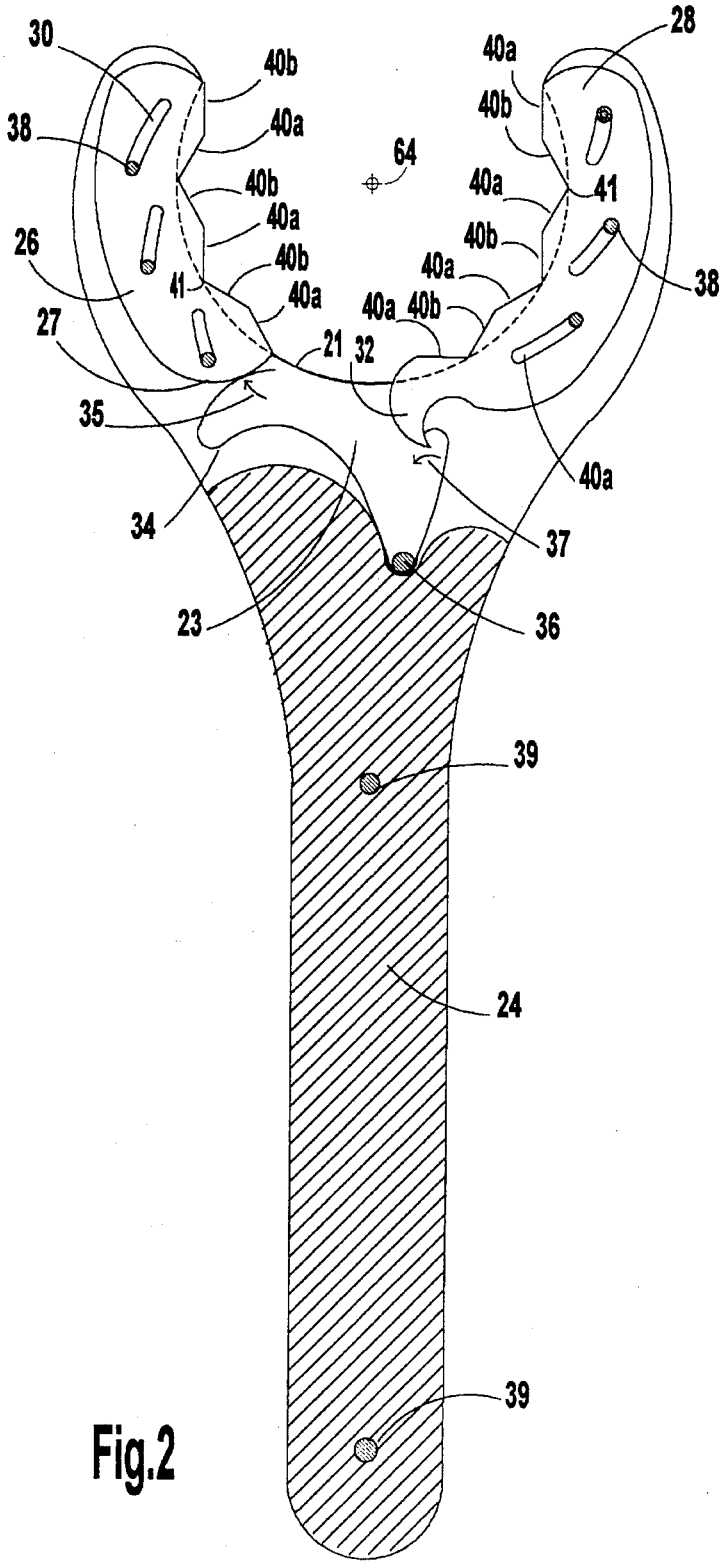
FIG. 2 shows the wrench of FIG. 1 with the front face plate removed to illustrate a pair of elongated plates that are pivotally mounted on the wrench by the engagement of pins within curved slots in the plates.
Figure 3:
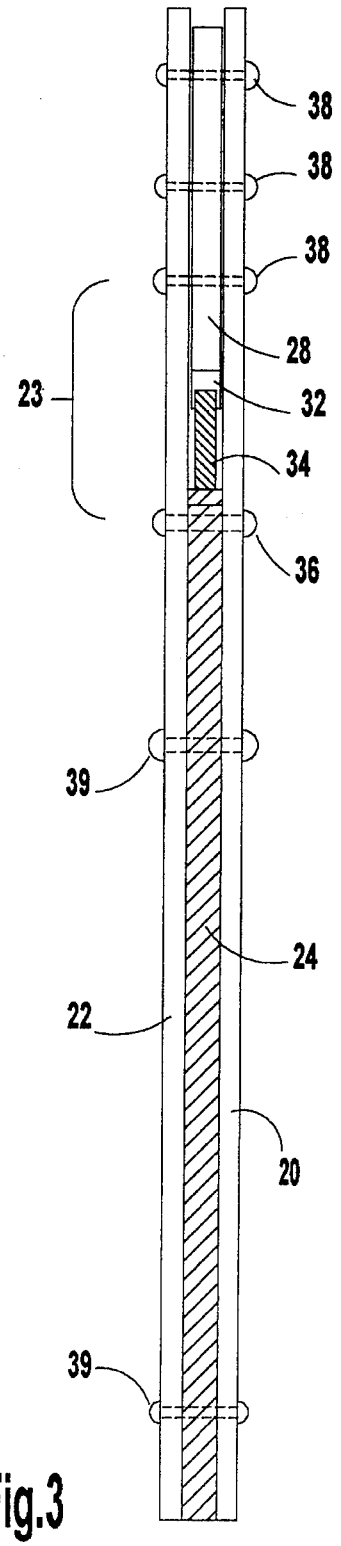
FIG. 3 is a side view of the wrench of FIG. 1.

Referring to FIGS. 1–3, open-end ratchet wrench 15 includes a pair of arcuate jaws 16, 17 at the end of an elongated handle 18. Jaws 16, 17 and handle 18 are defined by a pair of face plates 20, 22 (FIG. 3). A central plate 24 is sandwiched between face plates 20, 22 in handle 18 to provide space in jaws 16, 17 for a pair of pivotally mounted, elongated plates 26, 28 that are biased together by a leaf spring 34 mounted in handle 18. Plates 20, 22, 24 are secured together in handle 18 by a set of screws 39.

As best shown in FIGS. 1 and 2, face plates 20, 22 extend longitudinally beyond central plate 24 to form generally "C" shaped head 19 in which arcuate jaws 16, 17 are disposed. Jaws 16, 17 are spaced from each other by any suitable amount to partially encircle a central opening 21 for receiving a workpiece (e.g., the head of a bolt, a nut, or an in-line fitting) by no more than 240 degrees. As a result, sufficient spacing S is provided between the tips of jaws 16, 17 to allow wrench 15 to be inserted onto the workpiece from the side rather than from above (or below) the workpiece.

Elongated plates 26, 28 are curved (more specifically, reniform, or kidney, shaped) and are slightly thinner than central plate 24 (FIG. 3) so that they may move easily between the face plates 20, 22. The inner concave sides of elongated plates 26, 28 (i.e., the sides of plates 26, 28 that oppose each other) are each notched to define a series of cusps 40, each of which is defined by a pair of flat surfaces **40*a*, 40*b*. A pair of notches 41 are defined by adjacent cusps 40 of plate 26, while three such notches 41 are formed by adjacent cusps 40 of elongated plate 28. Elongated surfaces 40*a*, 40*b* that meet at a notch 41** are oriented at an angle that matches the angle defined by a pair of adjacent faces of the workpiece (which, for a hexagonal bolt head or nut, is 120 degrees).

When elongated plates 26, 28 are in their rest position (shown by FIGS. 1 and 2), their elongated surfaces **40*a*, 40*b* extend into central opening 21 by an amount sufficient to engage and grasp the faces of a hexagonal workpiece when holding a hexagonal workpiece in the position shown in FIGS. 1 and 2 or in a position rotated by 30 degrees from that shown in FIGS. 1 and 2. Each elongated surface 40*a*, 40*b* is configured to engage a face of the workpiece over a major portion (such as at least 54%) of the length of the face. Elongated plates 26, 28 are restrained in their movement and held between face plates 20, 22 by pins 38 which pass from face plate 20 to face plate 22 through arc-shaped slots 30 in elongated plates 26, 28. Pins 38 are secured to face plates 20, 22** in any suitable way.

A curved leaf spring 34 is placed in a base 23 of head 19 at the end of handle 18 and is captured between face plates 20, 22 (FIG. 3). Leaf spring 34 is retained between a post 36 and the end of central plate 24. Leaf spring 34 is configured so that one of its ends pushes against a base 27 of elongated plate 26 in the direction of arrow 35 (FIG. 2) to bias elongated plate 26 distally toward the tip of head 19 and pins 38 against the ends of slots 30 as shown; this motion and the length and orientation of slots 30 biases elongated surfaces **40*a*, 40*b* of plate 26 into central opening 21. The opposite end of leaf spring 34 fits within a hook-like projection 32 on the base of elongated plate 28, and biases elongated plate 28 in the direction of arrow 37 until pins 38 engage the ends of slots 30 as shown; the action of spring 34 and the orientation and length of slots 38 causes elongated surfaces 40*a*, 40*b* of elongated plate 28 to project into central opening 21**.

Figure 4:
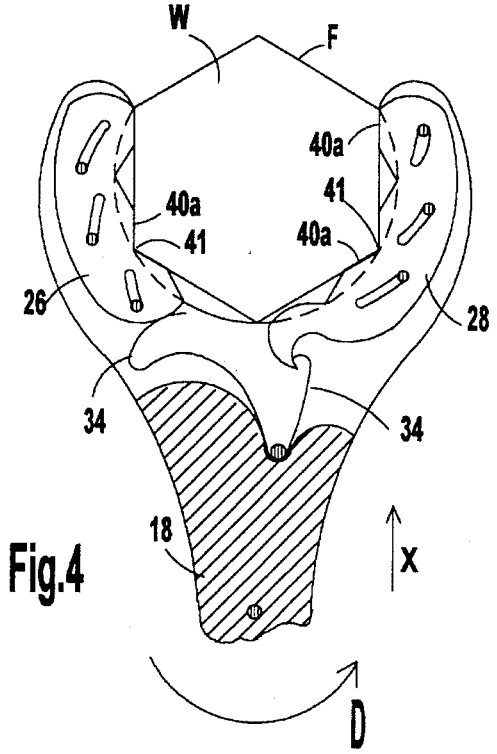
FIG. 4 illustrates the operation of the wrench of FIGS. 1–3 to turn a workpiece in the driving direction (D).
Figure 5:
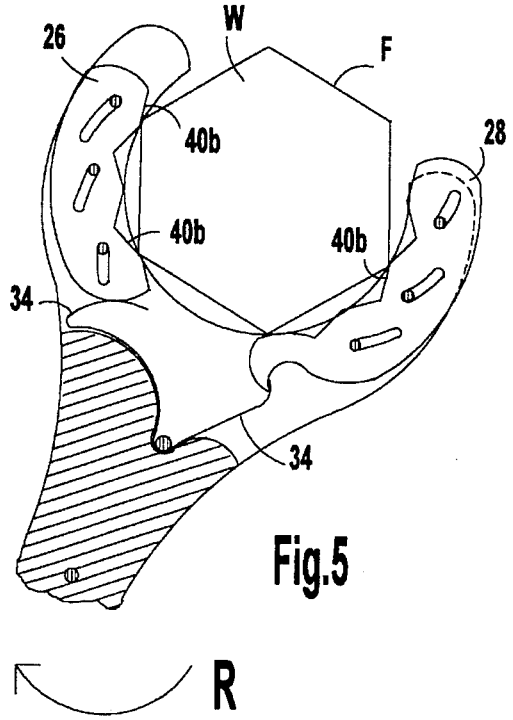
FIG. 5 illustrates the operation of the wrench of FIGS. 1–3 in the non-driving (ratcheting) direction (R).

FIGS. 4 and 5 (which show wrench 15 with plate 20 removed for ease of explanation) illustrate the operation of wrench 15 (to rotate workpiece W) in the driving direction (FIG. 4) and in the ratcheting direction R (FIG. 5). Wrench 15 is inserted onto workpiece W (shown as a hexagonal bolt head) from the side. That is, jaws 16, 17 are inserted onto workpiece W by sliding wrench 15 in the direction of arrow X along handle 18. To provide a frame of reference, the rotational position of workpiece W shown in FIG. 4 will be considered to be 0 degrees. Elongated surfaces **40*a* of plates 26, 28 can be seen to snugly engage several of the elongated faces F of workpiece W. As FIG. 4 illustrates, the corners of workpiece W between adjacent faces F fit neatly within notches 41 in elongated plates 26, 28**.

By pushing elongated plate 26 in the direction of arrow 35 (FIG. 2) and pulling elongated plate 28 in the direction of arrow 37, leaf spring 34 resiliently urges elongated plates 26, 28 against workpiece W, thereby causing elongated plates 26, 28 to grasp workpiece faces F therebetween. When the user rotates wrench handle 18 in the direction of arrow D (i.e., counterclockwise in FIG. 4), the arcuate configuration of slots 30 and the positions of the pins 38 at the respective ends of slots 30 prevent elongated plates 26, 28 from moving radially outwardly (i.e., away from workpiece W). As a result, the force applied by the user is exerted through elongated surfaces 40*a* to workpiece W so that wrench 15 rotates workpiece W.

Rotating wrench handle 18 in the opposite direction (i.e., in the direction of arrow R in FIG. 5) produces ratcheting action, which causes workpiece W to remain stationary as handle 18 is turned. That is, rotation of handle 18 in the direction of arrow R applies pressure to workpiece W via surfaces 40*b* that are oriented in-line with slots 30. The configuration of slots 30 and the positions of pins 38 at the respective ends of slots 30 allow elongated plates 26, 28 to move radially outwardly in response to this pressure, thereby causing elongated plates 26, 28 to slip over workpiece W as handle 18 is turned. Leaf spring 34 is compressed by the movement of elongated plate 26 and is expanded by motion of elongated plate 28.

FIG. 5 illustrates the motion of handle 18 in the ratcheting (i.e., non-driving) direction R. Workpiece W remains stationary, and the pressure applied by the user is exerted against elongated surfaces 40*b*. Elongated plates 26, 28 slide outwardly and radially, overcoming the biasing of leaf spring 34. Elongated surfaces 40 of plates 26, 28 are pushed outwardly to allow elongated plates 26, 28 to slide over faces F past the corners workpiece W; once the corners are passed, elongated plates 26, 28 move inwardly again, under the influence of leaf spring 34. With a 30 degree rotation in non-driving direction R, workpiece W is engaged again.

Figure 6:
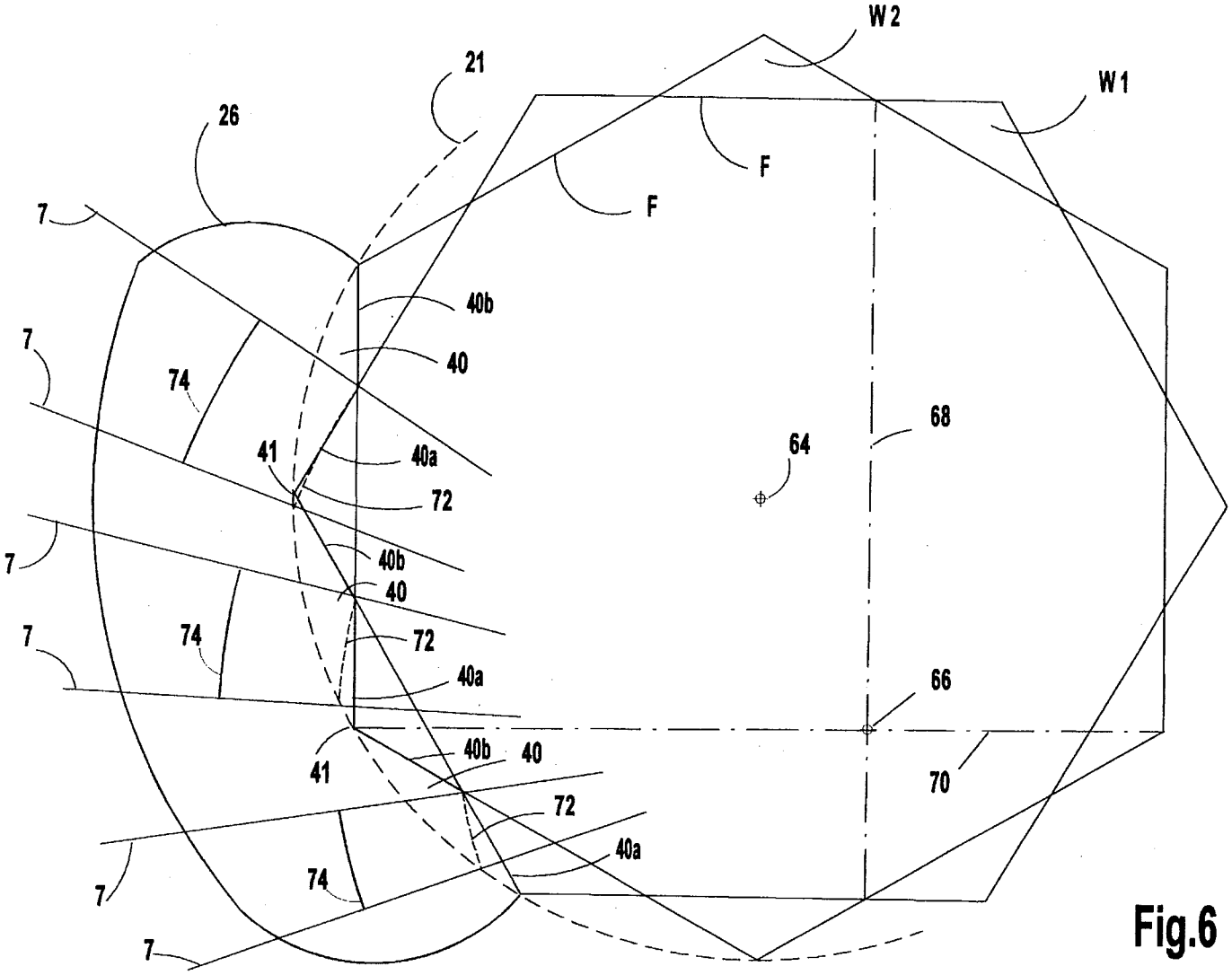
FIG. 6 is useful in understanding how the elongated plates of FIG. 1 are configured.

FIG. 6 is useful in understanding how elongated surfaces 40*a*, 40*b* and slots 30 of elongated plate 26 are laid out. (As will become clear from the following discussion, the layout of elongated surfaces 40*a*, 40*b* and slots 30 of elongated plate 28 is obtained in a similar manner.) First, the workpiece is drawn at orientations of 0 degrees of rotation (W1) and 30 degrees of rotation (W2) (i.e., W2 is rotated 1/12 of a turn from W1). The orientations of the faces F of the workpiece in respective positions W1 and W2 yield the positions of elongated surfaces 40*a*, 40*b*.

Line 68 is drawn vertically through the intersection of workpiece positions W1 and W2 on the opposite side of the center 64 of the workpiece from elongated plate 26. A transverse line 70 is drawn through the two lower corners of the workpiece in position W1 as shown. The point of intersection 66 of lines 68, 70 is the center of rotation for elongated plate 26. Note that center of rotation 66 is offset from center 64 of the workpiece.

The fact that center of rotation 66 is offset from workpiece center 64 is important because of the type of motion that elongated plate 26 undergoes. The motion of elongated plate 26 is neither linearly outward from center 64 of workpiece W nor arcuate with the rotation of workpiece W. Instead, elongated plate 26 moves helically with respect to workpiece center 64. Point 66 is the center of the helical motion of elongated plate 26 and serves as the origin about which arcs 72 (which, as discussed below, define the motion of cusps 40 within central opening 21) are drawn.

The inventor determined the location of center of rotation 66 through trial and error. The optimal location of center 66 is one which allows arcs 72 to be defined: (1) substantially in-line with pressure exerted from faces F of workpiece W, thereby allowing elongated plate 26 to slide outward easily during ratcheting; (2) substantially parallel to workpiece faces F when wrench 15 is turned in the driving direction (D), thereby substantially resisting outward motion of elongated plate 26 during driving; and (3) as small as possible to minimize the amount of motion needed to slide elongated plate 26 out of the way during ratcheting. Although lines 68, 70 intersect at center of rotation 66, these lines are arbitrary and serve to reference center of rotation 66 to workpiece W and wrench 15.

As discussed above, cusps 40 between elongated surfaces 40*a* 40*b* must move at least to the edge of central opening 21 (shown in dashed lines in FIG. 6) to allow ratcheting to occur. During ratcheting, the tip of each cusp 40 moves along an arc 72 (the center of which is center of rotation 66) as the tip moves toward the edge of central opening 21. Each arc 72 extends 12 degrees between a pair of rays 7 that radiate from center of rotation 66.

During operation, the pressure exerted by workpiece W against elongated plate 26 is applied at 90 degrees to lines (not shown) drawn from workpiece center 64 and corners of workpiece W (i.e., the intersections of adjacent faces F) that are captured by elongated plate 26. Put another way, the pressure is applied tangentially to the edge of opening 21 at each notch 41. Because of the orientation of arcs 72, pressure exerted by workpiece W against elongated surfaces 40*b* causes elongated plate 26 to spiral outwardly, thereby allowing ratcheting. Conversely, pressure exerted by workpiece W against elongated surfaces 40*a* causes elongated plate 26 to move inwardly, gripping workpiece W so that wrench 15 rotates workpiece W during driving.

Arcs 74 are centered at point 66 and placed in the approximately the center of elongated plate 26 in the width dimension. Each arc 74 is associated with an arc 72 and extends between the same pair of rays r as that arc 72; thus, arcs 74 are proportional in length to arcs 72. Each arc 74 describes the position, length and curve of a slot 30. Using point 66 as a center of rotation, it is seen that elongated plate 26 moves in a complex motion that causes plate 26 to spiral outwardly as plate 26 moves from the position shown in FIG. 4 to that shown in FIG. 5. Elongated plate 26 does not rotate around center 64 of the workpiece; nor does elongated plate 26 radially out from point 64. Instead, by moving about point 66, a spiraling, outward motion is observed.

Point 66 has been identified as providing maximum resistance to retrograde motion of workpiece W (i.e., rotation of workpiece W in the direction of arrow R in FIG. 5), because the arcs of motion centered at point 66 are virtually perpendicular to the direction of pressure of the workpiece edges on elongated plate 26 when retrograde rotation is attempted. As a result, turning wrench in the direction of arrow R causes ratcheting, rather than rotation of workpiece W. Antegrade (outward) motion of elongated plate 26 is permitted, however, because arcs 74 of motion of elongated plate 26 are parallel to the forces transmitted into elongated plate 26 by the workpiece face during antegrade motion. As a result, elongated plate 26 can then easily slide out of the way to allow the workpiece to clear. Point 66 is also unique in requiring a relatively short arc of outward motion of elongated plate 26 during ratcheting to allow workpiece W to clear.

Wrench 15 eliminates many of the complications and manufacturing difficulties of conventional wrenches, while accomplishing the requirements of an open end ratchet wrench. Among other advantages, wrench 15 is simple in construction and has only three moving parts—elongated plates 26, 28 and spring 34. The mechanism for retaining elongated plates 26, 28 can be varied and tailored as desired to accommodate the type, shape and size of workpiece W to be engaged. Wrench 15 can approach workpiece W directly from the side, does not need to completely encircle workpiece W (only partially surrounding workpiece W by 240 degrees), and can easily be removed without the need for additional tools or intricate maneuvers. In addition, wrench W can easily be cleaned due to its open construction. Only 1/12th of a turn (i.e., 30 degrees of retrograde, ratcheting motion) is needed to re-cock wrench 15 (FIG. 5) and again advance workpiece W (FIG. 4). Further, wrench 15 is not much larger than an ordinary, open-end wrench (such as a crescent wrench).

Other embodiments are within the scope of the following claims. For example, slots 30 may alternatively be formed on jaws 16, 17 and pins 30 disposed on elongated plates 26, 28.

Figure 7:
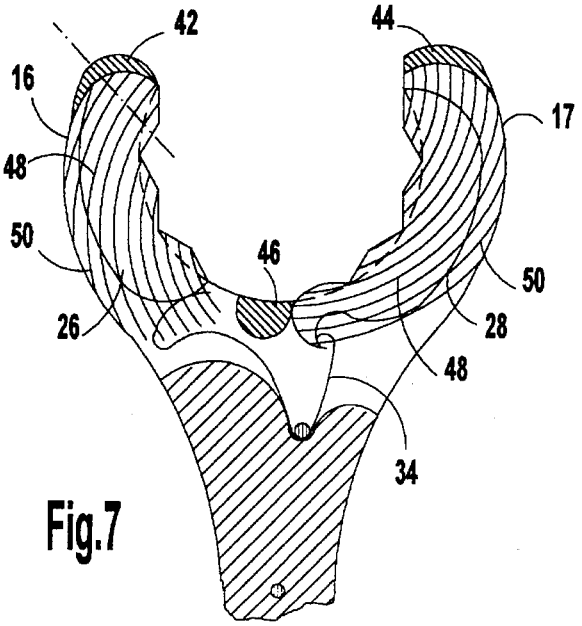
FIG. 7 shows an alternative embodiment of the open-end ratchet wrench of FIG. 1, in which the elongated plates are pivotally mounted by the engagement of curved grooves and curved ridges.

Referring to FIG. 7, elongated plates 26, 28 may be pivotally mounted to jaws 16, 17 in other ways. A set of curved ridges 48 on the surfaces of elongated plates 26, 28 fit within a corresponding set of grooves 50 on the inside surfaces of face plates 20, 22 in jaws 16, 17. (Alternatively, ridges 48 may be formed on jaws 16, 17 and grooves 50 cut in elongated plates 26, 28.) The curvatures of ridges 48 and grooves 50 are determined in the manner discussed above and illustrated by FIG. 6 and define the pivotal motion of elongated plates 26, 28. The movement of elongated plate 26 into central opening 21 is limited by a distal retaining plate 42 disposed at the tip of jaw 16. A similar distal retaining plate 44 at the tip of jaw 17 restricts the outward and distal motion of elongated plate 28. Front and rear plates 20, 22 are connected together through retaining plates 42, 44, thereby strengthening jaws 16, 17.

A retainer 46 disposed at the proximal end of head 19 restricts the inward and proximal movement of elongated plate 28. Front and rear face plates 20, 22 are connected together through retainer 46 for added rigidity.

Figure 8:
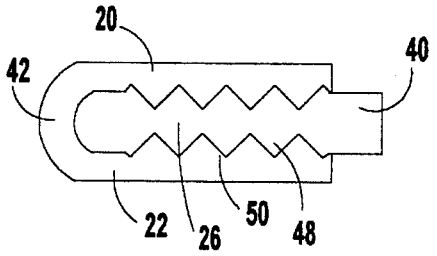
FIG. 8 shows one configuration of the grooves and ridges of FIG. 7.
Figure 9:
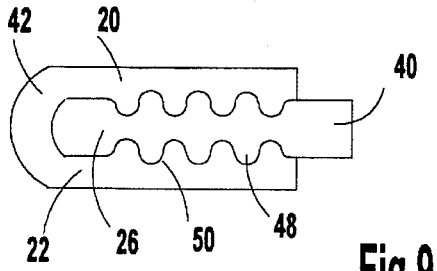
FIG. 9 shows a second configuration of the grooves and ridges of FIG. 7.

Referring to FIGS. 8 and 9, ridges 48 and grooves 50 can have any suitable cross-section. In FIG. 8, ridges 48 and grooves 50 are both triangular in shape and have straight sides that meet at sharp crests. Alternatively, the sides of ridges 48 and grooves 50 may be curved, as shown in FIG. 9, so as to meet at rounded crests.

One advantage obtained with the-groove configurations of FIGS. 7–9 is a large area of contact between front and rear face plates 20, 22 and elongated plates 26, 28, due to the interlocking nature of the ridges 48 and grooves 50. This provides a strong, rigid assembly with even fewer components than the embodiment shown in FIG. 1 (because individual pins 38 are eliminated). As a result, fabrication is simplified still further. The rigidity provided by the ridge-in-groove construction allows the size of elongated plates 26, 28 to be reduced (so that wrench 15 can be miniaturized) while retaining the ability to deliver large forces to the workpiece.

Referring to FIG. 10, wrench 15 can be made larger to apply added force to a larger workpiece W. In this case, elongated plates 26, 28 are larger than those shown in FIG. 1. The added forces are accommodated through the use of additional slots 30 and pins 38 (e.g., four, in this embodiment), and by increasing the diameter (i.e., the width) of slots 30 and pins 38.

Referring to FIG. 11, wrench 15' is modified in two ways with respect to wrench 15. First, its elongated plates 26', 28' are relatively small and include only a pair of slots 30 that are engaged by a pair of pins 38 in jaws 16', 17'. In addition, elongated surfaces 52 of plates 26', 28' are flat, and project further into central opening 21 than cusps 40 (FIG. 1). Thus, in this embodiment, slots 30' are relatively long with respect to the size of plates 26', 28' to allow greater outward motion of elongated plates 26', 28', thereby permitting surfaces 52 to move sufficiently so as not to project into central opening 21 when rotating wrench 15 in the ratcheting direction. Due to the configuration of plates 26', 28', wrench 15' must be turned a full 1/6th turn (i.e., 60 degrees) in the ratcheting direction before the workpiece can be reengaged for further driving.

If central opening 21 defined by jaws 16', 17' is sufficiently small (such as less than ½ inch), it may be advantageous to use the groove-and-ridge design of FIGS. 7–9 in place of slots 30' and pins 38' (which would be relatively small, and thus potentially difficult to fabricate, for small wrenches).

FIG. 12 illustrates yet another modification of wrench 15. The thickness of rear face plate 22' is reduced relative to that of front face plate 20' to allow elongated plates 26, 28 to engage the sides of a nut 63 (one example of a workpiece W) which is relatively flat. Front face plate 20' is made correspondingly thicker and provides the majority of support for pivot pins 38. Front face plate 20 is further modified by the presence of an inner lip 62 extending in and decreasing the size of central opening 21'. Wrench 15 can still be inserted onto nut 63 from the side as long as central opening 21' is not smaller than the member 65 to which nut 63 attaches (e.g., a bolt or an in-line fitting).

Lip 62 helps maintain wrench 15 on flat nut 63 and assures proper contact between the elongated plates 26, 28 and nut 63. (Compare this configuration with that of FIG. 13, which is an end view of wrench 15 of FIG. 1, which does not include lip 62, inserted on workpiece W.) Note that the embodiment of wrench 15 shown in FIG. 12 is a one-way tool—it can be used either to tighten or loosen nut 63, but not both, because lip 62 would interfere with inserting wrench 15 onto nut 63 if the wrench were to be turned over. One solution would be to provide a pair of wrenches 15—one for tightening nut 63 and the other for loosening nut 63—with lips on face plates 20, 22, respectively.

Referring to FIGS. 14–17, wrench 15" includes a strong, reliable, simple mechanism that allows unidirectional motion of a ratchet insert member 54 that forms part of the workpiece and engages the faces of, e.g., a nut to be rotated. Insert member 54 is held between jaws 16, 17 by elongated plates 26, 28. Insert member 54 is formed with upper projection **58*a* and lower projection 58*b* (FIG. 17) each of which extends circumferentially thereabout within a circular arc of 240 degrees. Between projections 58*a*, 58*b* are formed a plurality of teeth 56 (FIG. 16) on the external surfaces of insert member 54. Upper projection 58*a* is held within central opening 21 of front face plate 20, and lower projection 58*b* is held within central opening 21 of rear face plate 22. Teeth 56 of insert member 54 are captured by cusps 40 of elongated plates 26, 28. Inner surface 60 of insert member 56** is made with parallel, flat surfaces that engages the faces of nuts, bolts etc.

Still other embodiments are within the scope of the claims.

What is claimed is:

1. A wrench comprising a pair of jaws disposed on a handle, said jaws being spaced by an amount selected to allow said jaws to be inserted on a workpiece, a pair of elongated plates each of which is pivotally mounted to one of said jaws, each of said elongated plates including at least one elongated surface for engaging a face of said workpiece, and a spring mounted to engage each one of said elongated plates and resiliently bias said elongated plates toward each other so that said elongated plates grasp said workpiece between said elongated surfaces and rotate said workpiece when said handle is rotated in a first direction, said bias being overcome when said handle is rotated in a second, opposite direction so that said elongated surfaces of said plates slide over faces of said workpiece allowing said workpiece to remain stationary.

2. The wrench of claim 1 wherein each one of said elongated surfaces is further arranged to engage a said face of said workpiece over a major portion of the length of said face.

3. The wrench of claim 1 wherein each one of said elongated plates further comprises at least one notch that defines a plurality of said elongated surfaces each of which is arranged to engage a said face of said workpiece.

4. The wrench of claim 3 wherein said plurality of elongated surfaces defined by said at least one notch are further arranged so that an angle therebetween equals an angle between a pair of adjacent faces of said workpiece.

5. The wrench of claim 1 wherein each one of said elongated plates includes a plurality of notches each of which defines a plurality of said elongated surfaces each of which is arranged to engage a said face of said workpiece, said plurality of notches being arranged so that the elongated faces defined by adjacent ones of said notches do not simultaneously engage said faces of said workpiece.

6. The wrench of claim 3 wherein said pair of plates include different numbers of said at least one notch.

7. The wrench of claim 1 wherein said elongated plates and said spring are further arranged so that when said wrench is turned over with respect to said workpiece, said wrench rotates said workpiece when said handle is rotated in the second direction.

8. A wrench comprising a pair of jaws disposed on a handle, said jaws being spaced by an amount selected to allow said jaws to be inserted on a workpiece, a pair of elongated plates each of which is pivotally mounted to one of said jaws, each of said elongated plates including at least one elongated surface for engaging a face of said workpiece, each one of said elongated plates comprising a plurality of notches each of which defines a plurality of said elongated surfaces each of which is arranged to engage a said face of said workpiece, a spring for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary, and an insert member that forms a first part of said workpiece and is constructed to fit within said notches of said plates and receive a second part of said workpiece that is to be rotated by said wrench.

9. A wrench comprising a pair of jaws disposed on a handle, said jaws being spaced by an amount selected to allow said jaws to be inserted on a workpiece, a pair of elongated plates each of which is pivotally mounted to one of said jaws by engagement of a plurality of pins on said jaw within a corresponding plurality of slots on said elongated plate, each of said elongated plates including at least one elongated surface for engaging a face of said workpiece, and a spring for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary.

10. The wrench of claim 9 wherein said plurality of slots in each said elongated plate are curved and have a common center of curvature.

11. The wrench of claim 10 wherein said center of curvature is offset from a center of said workpiece.

12. A wrench comprising a pair of jaws disposed on a handle, said jaws being spaced by an amount selected to allow said jaws to be inserted on a workpiece, a pair of elongated plates each of which is pivotally mounted to one of said jaws by engagement of at least one curved ridge on said elongated plate with at least one curved groove on said jaw, each of said elongated plates including at least one elongated surface for engaging a face of said workpiece, and a spring for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary.

13. The wrench of claim 12 wherein said at least one curved ridge and said at least one curved groove have a triangular cross section.

14. The wrench of claim 12 wherein said at least one curved ridge and said at least one curved groove have a semicircular cross section.

15. A wrench comprising a pair of jaws disposed on a handle, said jaws being spaced by an amount selected to allow said jaws to be inserted on a workpiece, a pair of elongated plates each of which is pivotally mounted to one of said jaws, each of said elongated plates including at least one elongated surface for engaging a face of said workpiece, and a spring for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary, said spring comprising a leaf spring having a pair of ends that respectively engage said pair of elongated plates.

16. The wrench of claim 15 wherein at least one of said elongated plates includes a hook for receiving a said end of said leaf spring.

17. A wrench comprising a pair of jaws disposed on a handle, said jaws being spaced by an amount selected to allow said jaws to be inserted on a workpiece, a pair of elongated plates each of which is pivotally mounted to one of said jaws, each of said elongated plates including at least one elongated surface for engaging a face of said workpiece, a spring for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary, and said jaws and said handle being defined by a pair of face plates that are secured together, said elongated plates and said spring being captured between said face plates.

18. The wrench of claim 17 wherein each of said jaws defined by a first one of said face plates includes a lip for retaining said wrench on said workpiece.

19. The wrench of claim 18 wherein said first one of said plates has a thickness greater than that of a second one of said pair of face plates.

20. The wrench of claim 17 wherein each one of said elongated plates is pivotally mounted to at least one of said pair of face plates by engagement of a plurality of pins on said at least one of said face plates within a corresponding plurality of slots on said elongated plate.

21. The wrench of claim 20 wherein each one of said elongated plates is pivotally mounted to both of said pair of face plates by engagement of a plurality of pins on said pair of said face plates within a corresponding plurality of slots on said elongated plate.

22. The wrench of claim 17 wherein each one of said elongated plates is pivotally mounted to at least one of said pair of face plates by engagement of at least one curved ridge on said elongated plate with at least one curved groove on said at least one of said face plates.

23. The wrench of claim 22 wherein each one of said elongated plates is pivotally mounted to both of said pair of face plates by engagement of at least one curved ridge on said elongated plate with at least one curved groove on said pair of said face plates.

24. A wrench comprising a pair of jaws disposed on a handle, said jaws being spaced by an amount selected to allow said jaws to be inserted on a workpiece, a pair of elongated plates each of which includes a plurality of elongated surfaces arranged to engage faces of said workpiece, said pair of elongated plates being pivotally mounted to said jaws by engagement between a set of pins on said jaws and a corresponding set of curved slots in said elongated plates, and a leaf spring mounted on said handle, said leaf spring having a pair of ends that respectively engage said pair of elongated plates for biasing said elongated plates toward each other so that said elongated plates grasp said workpiece between said elongated surfaces and rotate said workpiece when said handle is rotated in a first direction, said biasing being overcome when said handle is rotated in a second, opposite direction so that said elongated surfaces of said plates slide over faces of said workpiece, allowing said workpiece to remain stationary.

* * * * *